US010900158B2

(12) United States Patent
Richter et al.

(10) Patent No.: US 10,900,158 B2
(45) Date of Patent: Jan. 26, 2021

(54) NOZZLE BAR AND METHOD

(71) Applicant: AUTEFA SOLUTIONS GERMANY GMBH, Friedberg (DE)

(72) Inventors: Christian Richter, Augsburg (DE); Anton Mooshammer, Aschersleben (DE)

(73) Assignee: AUTEFA SOLUTIONS GERMANY GMBH, Friedberg (DE)

( * ) Notice: Subject to any disclaimer, the term of this patent is extended or adjusted under 35 U.S.C. 154(b) by 469 days.

(21) Appl. No.: 15/302,688

(22) PCT Filed: Apr. 1, 2015

(86) PCT No.: PCT/EP2015/057254
§ 371 (c)(1),
(2) Date: Oct. 7, 2016

(87) PCT Pub. No.: WO2015/155104
PCT Pub. Date: Oct. 15, 2015

(65) Prior Publication Data

US 2017/0029995 A1 Feb. 2, 2017

(30) Foreign Application Priority Data

Apr. 8, 2014 (DE) ..... 20 2014 101 647 U

(51) Int. Cl.
*D04H 18/04* (2012.01)
*B05B 1/20* (2006.01)
*D04H 1/492* (2012.01)

(52) U.S. Cl.
CPC ..... *D04H 18/04* (2013.01); *B05B 1/202* (2013.01); *D04H 1/492* (2013.01)

(58) Field of Classification Search
CPC ..... D04H 18/04; D04H 18/00; D04H 1/46; D04H 3/11; D04H 1/465; D04H 1/492; D04H 1/495; D04H 5/04; B24C 3/325; B05B 1/202; B41F 7/30; B05D 3/12
USPC ..... 28/104; 239/548, 556, 567, 451, 456
See application file for complete search history.

(56) References Cited

U.S. PATENT DOCUMENTS 3,493,462 A * 2/1970 Bunting, Jr. ..... D04H 1/492 442/405
3,613,999 A * 10/1971 Bentley ..... D04H 18/04 239/553.3
3,710,460 A * 1/1973 Segraves ..... D01D 10/0481 28/271
5,435,708 A * 7/1995 Kaun ..... D01D 4/025 264/169

(Continued)

FOREIGN PATENT DOCUMENTS

DE 20 2008 010204 U1 10/2008
DE 20 2010 009563 U1 9/2010

(Continued)

*Primary Examiner* — Jillian K Pierorazio
(74) *Attorney, Agent, or Firm* — McGlew and Tuttle, P.C.

(57) ABSTRACT

A jet manifold (10) and a method for a hydroentanglement device (1) are provided. The jet manifold (10) has a hollow housing (11) that includes a housing shell (12). An opening (13) is provided in the housing shell. A nozzle strip (16) is located in the housing (11) and has a tub-shaped cross-section with a nozzle body (19). The nozzle body (19) is recessed in the opening (13) in the housing shell.

20 Claims, 5 Drawing Sheets

(56) References Cited

U.S. PATENT DOCUMENTS

| | | | | |
|---|---|---|---|---|
| 5,643,058 | A * | 7/1997 | Erichsen | B24C 1/045 451/100 |
| 5,737,813 | A | 4/1998 | Sternlieb et al. | |
| 6,715,701 | B1 * | 4/2004 | Julien | B05B 1/10 239/429 |
| 6,942,167 | B2 * | 9/2005 | Fleissner | B05B 1/14 239/555 |
| 8,900,411 | B2 * | 12/2014 | Konishi | D21F 11/145 162/115 |
| 2002/0179744 | A1 | 12/2002 | Noelle et al. | |
| 2003/0209613 | A1 * | 11/2003 | Miyauchi | B05B 7/02 239/418 |
| 2005/0125908 | A1 * | 6/2005 | Pourdeyhimi | D06C 29/00 8/115.51 |
| 2006/0042057 | A1 * | 3/2006 | Taniguchi | D04H 18/04 28/104 |
| 2008/0092935 | A1 * | 4/2008 | Munstermann | B05B 1/1627 134/198 |
| 2011/0277284 | A1 * | 11/2011 | Muenstermann | D04H 1/02 28/104 |
| 2012/0096694 | A1 * | 4/2012 | Muenstermainn | D04H 1/46 28/104 |

FOREIGN PATENT DOCUMENTS

| | | | | |
|---|---|---|---|---|
| EP | 2 301 671 | A1 | 3/2011 | |
| EP | 2 302 119 | A1 | 3/2011 | |
| GB | 2 237 824 | A | 5/1991 | |
| GB | 2 319 266 | A | 5/1998 | |
| GB | 2319266 | * | 5/1998 | D04H 1/46 |
| JP | H102 46 947 | A | 9/1998 | |
| JP | 2001 029845 | A | 2/2001 | |
| WO | 03/064748 | A1 | 8/2003 | |

* cited by examiner 1
10
5
28
10
2
27
2
4
29
34
28
3
2
27
3
10
28
34
2
5
4
10
29
10
9
8

NOZZLE BAR AND METHOD

CROSS REFERENCE TO RELATED APPLICATIONS

This application is a United States National Phase Application of International Application PCT/EP2015/057254 filed Apr. 1, 2015, and claims the benefit of priority under 35 U.S.C. § 119 of German Application 20 2014 101 647.3 filed Apr. 8, 2014, the entire contents of which are incorporated herein by reference.

FIELD OF THE INVENTION

The pertains to a nozzle bar and to a method for a fluid jet treatment device, and especially for a hydroentanglement device, the nozzle bar having a hollow housing with a housing jacket and with a jacket opening as well as with a nozzle strip arranged in the housing.

BACKGROUND OF THE INVENTION

A nozzle bar for a hydroentanglement device which has a tubular housing with a housing jacket and with a slot-like, axial jacket opening there is known from practice. A flat nozzle strip is arranged on the inside in the housing and over the jacket opening. The water jets being discharged here are directed through the jacket opening and further to a material web to be entangled after discharge at the opening mouth. The results that can be achieved with such nozzle bars in practice are still not optimal.

SUMMARY OF THE INVENTION

Therefore, an object of the present invention is to demonstrate an improved nozzle technology.

According to the invention, a nozzle bar for a hydroentanglement device or other fluid jet treatment device, comprises a hollow housing with a housing jacket and with a jacket opening. A nozzle strip is arranged in the housing and has a trough-shaped cross section with a nozzle body that is arranged retracted in the jacket opening.

According to another aspect of the invention, a fluid jet treatment device, especially hydroentanglement device comprises a nozzle bar that has a hollow housing with a housing jacket and with a jacket opening as well as with a nozzle strip arranged there. The nozzle strip has a trough-shaped cross section and is arranged in the jacket opening.

According to another aspect of the invention a method is provided for fluid jet treatment, especially hydroentanglement, wherein fluid jets are directed toward a material web by means of a nozzle bar. The nozzle bar has a hollow housing with a housing jacket and with a jacket opening as well as with a nozzle strip arranged in the housing. Fluid jets are emitted by a nozzle strip, which has a trough-shaped cross section with a nozzle body that is arranged retracted in the jacket opening.

The nozzle technology according to the invention, i.e., the nozzle bar and the spraying method as well as the nozzle strip have a variety of advantages. On the one hand, a considerably improved jet guiding and jet action can be achieved. The fluid jets being discharged, and especially water jets, can be focused narrowly and sharply. In addition, the free jet length until striking the material web to be treated, especially to be entangled, is shortened. This leads to a reduction in divergence phenomena and to an optimization of the jet energy introduced to the material web. Diffusor effects and energy losses connected therewith can be mostly avoided.

Furthermore, a lateral pulling of condensation water in the jet discharge area at the nozzle bar can be avoided. The effects of thrown-back splash water are also reduced. Further, possibilities for improving the air guiding arise in case of a hydroentanglement device, which has a suction device on the other side of the material web, which acts on the fluid or water jets being discharged at the nozzle bar and on the ambient air.

Due to the configuration of the nozzle bar and of the nozzle strip according to the present invention, the discharge location of the fluid or water jets at the nozzle bar can be placed further outwards, as a result of which the free jet length is shortened in the manner mentioned above.

The improved jet guiding also permits an arrangement and alignment of nozzle bars and fluid or water jets being discharged, which were not possible up to now. In particular, the fluid or water jets being discharged can be directed from below upwards, which makes possible a tighter nozzle bar arrangement at the material web and a compact construction of the hydro entanglement device.

Thanks to the trough-shaped configuration according to the present invention, a plurality of rows of holes of fine nozzle orifices can be arranged next to one another at a nozzle strip. Consequently, the jet density can be increased, on the one hand. The water jets or nozzle jets being discharged do not interfere with each other thanks to the shortened free jet length and the convergence of jets, on the other hand. The claimed nozzle configuration can improve the constancy of the fluid jets being discharged under high pressure. A perforated cover on the nozzle body may also have a quality-increasing effect. The entanglement effect that can be achieved with the nozzle technology according to the present invention can thereby be considerably improved and optimized compared to the state of the art.

Further advantages are a reduction in air swirlings in the jet discharge area between the nozzle bar and the material web. The free jet length now starting on the outside of the nozzle bar permits, on the other hand, a greater distancing of the nozzle bar from the material web, which is advantageous for said swirl reduction.

In the case of the configuration and arrangement of the nozzle bar, the person skilled in the art has a greater variation and configuration range than in the state of the art. He can, e.g., minimize the free jet length in the manner mentioned or leave the free jet length in the same magnitude as in the state of the art and increase the distance between the nozzle bar and the material web for it. In the nozzle technology according to the present invention, the thickness of the housing jacket is no longer or hardly any longer included in the free jet length. In addition, the compression and pressure effect in the interior of the housing is improved by the trough-like cross-sectional shape of the nozzle strip. In the interior of the housing guiding means can distribute the fluid fed in better and ensure constant pressures over the nozzle length and at the jet discharge openings.

The reflection characteristics of the fluid jets or water jets on a carrier for the material web, which is improved thanks to improved utilization of energy, is advantageous as well. This improves the entanglement effect. In addition, a prewetting of the material web, especially a fibrous nonwoven web can be achieved. The prewetting leads to an improved bonding and adhesion of the fibers in the material web.

Further, a reduction in drag water on the material web results in being an advantage. As a result of this, the jet interferences originating from drag water can also be reduced. The air guiding, which is optimized thanks to the improved nozzle technology, permits, in addition, an improved removal of the water. Especially in case of a jet direction vertically or obliquely from below upwards, the splash water or spray water reflected by the material web and by the carrier can be led away better. The effect of gravity can be advantageously utilized for this.

The claimed nozzle technology leads, in addition, to a marked reduction in the consumption of fluid or water at the water entanglement device. Overall, the latter can be optimized in terms of its floor space requirement and in terms of its operating efficiency, as a result of which the cost is reduced as well and, on the other hand, the cost effectiveness compared to prior-art constructions increases markedly. In addition, the sealing technology improved thanks to the claimed nozzle technology is also advantageous.

The present invention is described in detail below with reference to the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
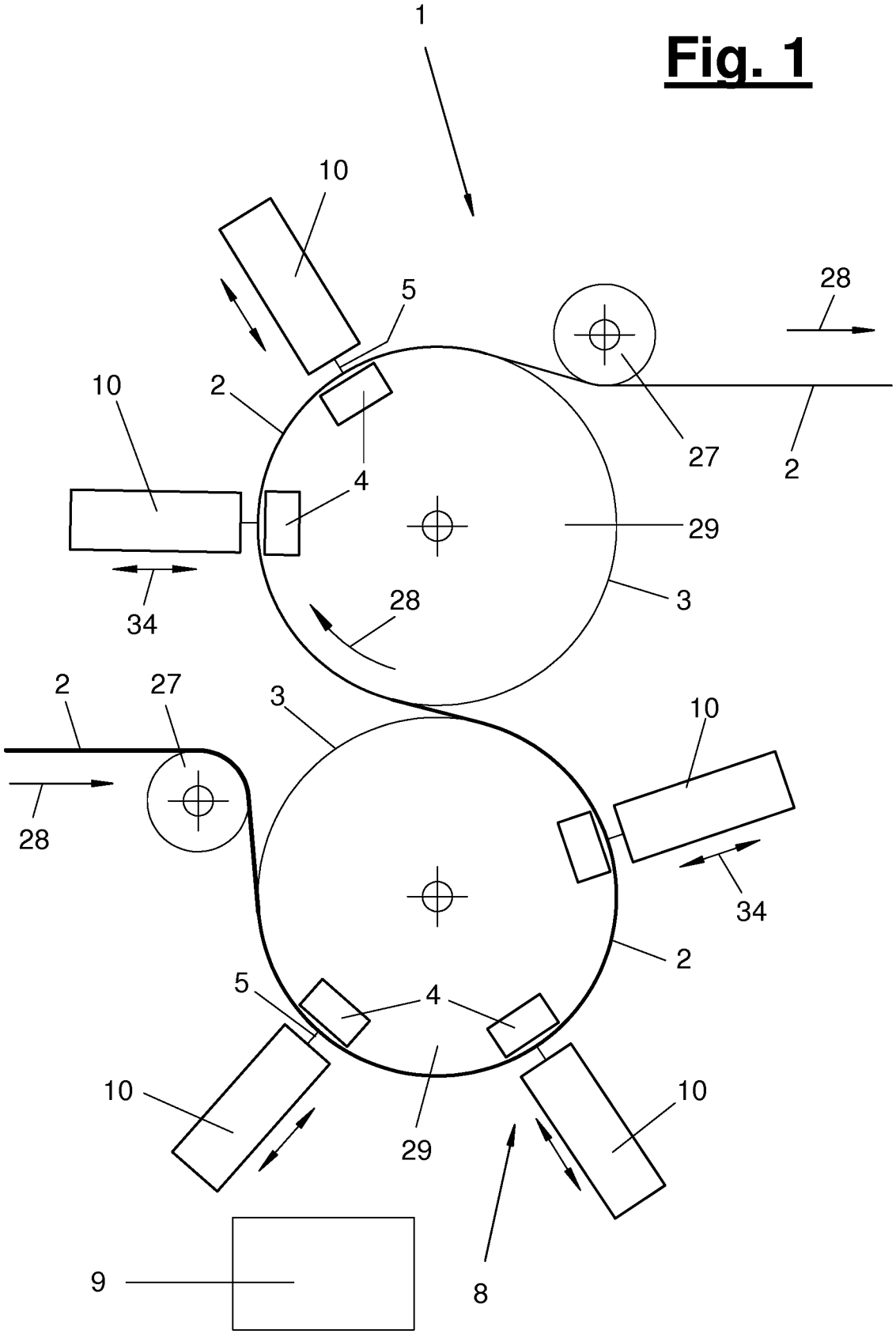
FIG. 1 is a hydroentanglement device with a plurality of nozzle bars in a schematic view.

Referring to the drawings, the present invention pertains to a nozzle bar (10) and a spraying method for a fluid jet treatment device (1). The present invention pertains, further, to a fluid jet treatment device (1) with one or more such nozzle bars (10) and to a method for the fluid jet treatment of a material web (2).

The fluid is preferably water. As an alternative, it may be a different liquid. Reference is made below to water and to a water jet treatment, wherein the technical teaching with corresponding adaptation also applies to other liquids.

The water jet treatment and the water jet treatment device (1) may concern the entanglement of a material web (2). As an alternative, they may concern a surface treatment, especially a finish, or other treatments of a material web (2). A method for hydroentanglement and a hydroentanglement device (1) are described below. The technical teaching applies with corresponding adaptation also to other water jet treatments and intended uses. The hydroentanglement device (1) and the method are also designated as spunlace or hydroentanglement.

Figure 2:
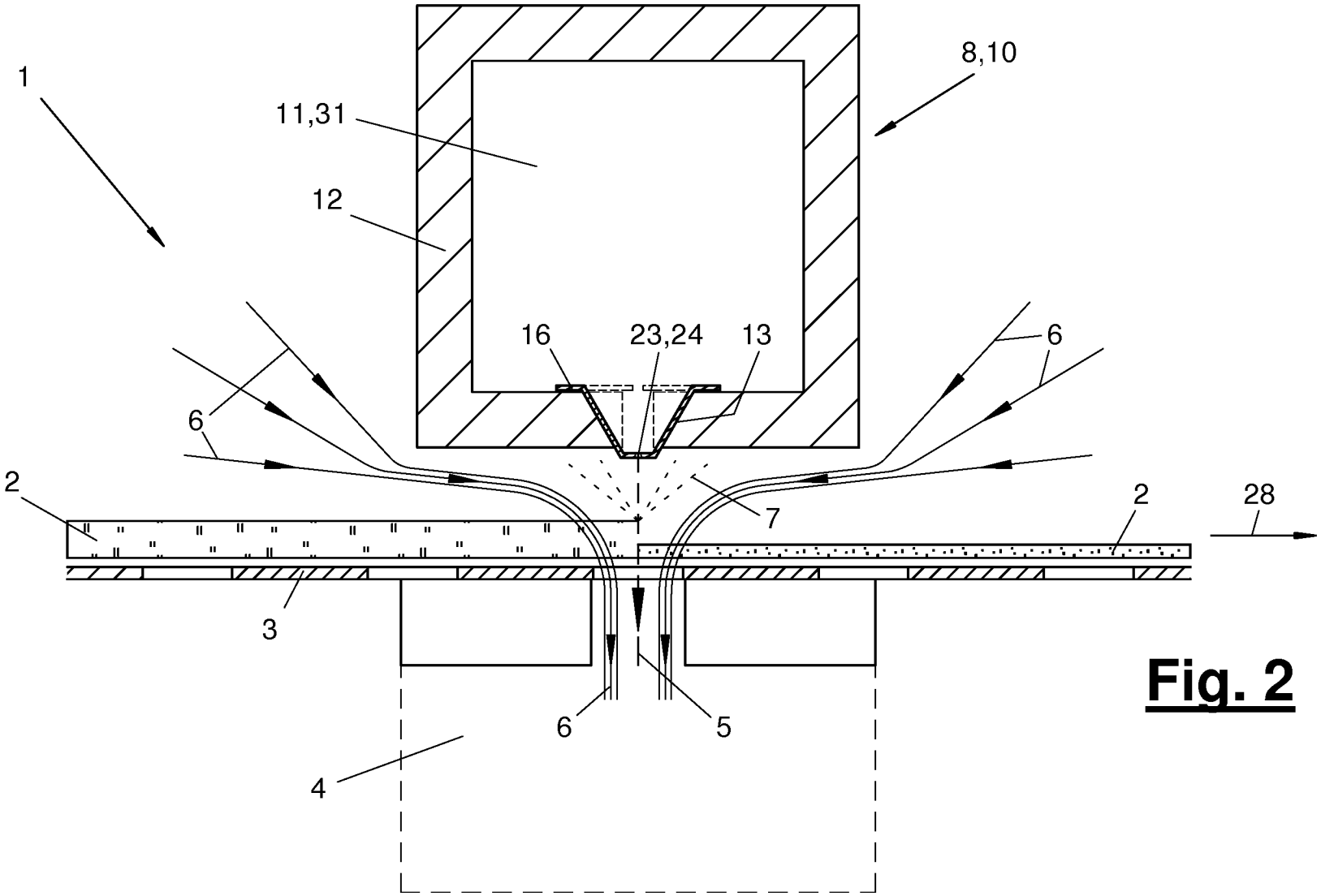
FIG. 2 is a schematic cross-sectional view of a nozzle bar together with material web and carrier.

The material web (2) may consist of any desired material that can be treated with water jets (5) and is especially capable of entanglement. In the preferred exemplary embodiment shown, the material web (2) consist of textile fibers, especially natural fibers and/or synthetic fibers in the cut short form (so-called staple fibers) or in the long form (so-called tow). It is preferably configured as a fibrous nonwoven web. Such a fibrous nonwoven is sometimes designated as a fibrous web as well. The compacting effect of the material web (2) occurring due to the hydroentanglement is schematically shown in FIG. 2. As an alternative, other textile, e.g., woven, material webs (2) are also possible.

A relative motion in a conveying direction (28) by means of a conveying device (27) takes place between the material web (2) and the hydroentanglement device (1). In the embodiment shown, the material web (2) is moved in relation to a preferably stationary hydroentanglement device (1). The conveying device (27) has, e.g., rollers for guiding and possibly for driving the material web (2). Such rollers are shown schematically and only partially in FIG. 1.

A carrier (3) is provided for supporting the material web (2) during the hydroentanglement and during the conveying. This carrier may have a planar or curved shape. The carrier (3) may, in addition, have a plurality of passage openings. It may be configured, e.g., as a screen belt, as a cylinder cover or as a grid.

In FIG. 1, the carrier (3) is formed, e.g., by adjacent rollers (29) and the cylinder cover thereof. FIG. 2 schematically shows the possibility of a screen belt (3), which is planar in at least some areas and which can be configured as inherently stable or flexurally elastic. The carrier (3) may be configured as stationary or movable. In FIG. 1, e.g., the rollers, especially screen rollers (29) rotate and are equipped with corresponding drives.

The hydroentanglement device (1) has a jet device (8), which emits one or more, and preferably a plurality of water jets (5) against the material web (2) and the carrier (3) lying under it. Further, a suction device (4) may be present and be arranged beyond the material web (2) on the other side of the carrier (3). The medium mentioned water is defined as, besides H2O, other fluids, especially liquids, which are suitable for the entanglement of a material web (2).

The jet device (8) has a nozzle bar (10) and a compressed water supply (9) shown schematically in FIG. 1. A plurality of nozzle bars (10) may also be present. In this case, a plurality of nozzle bars (10) may be connected to a common compressed water supply (9) or could, as an alternative, have their own compressed water supply each. In the compressed water supply (9), the water used for the hydroentanglement is prepared and fed under pressure into the hollow nozzle bar (10) on the inside. The water running off after the material exposure is collected and may possibly be fed again after a preparation in the closed circuit of the compressed water supply (9). As an alternative, it is possible to work with fresh water.

The nozzle bar (10) has an elongated bar shape and extends obliquely over the material web (2). In the embodiment shown, the nozzle bar (10) is arranged relatively stationary relative to the material web (2). The nozzle bar (10) has a hollow housing (11) with an interior (31) and a surrounding housing jacket (12). The housing jacket (12) may be a single part or multiple parts. It may be formed, e.g., by a plurality of side walls connected to one another. The nozzle bar (10) is suitably closed on the front side by a cover or the like. A high water pressure is built up in the hollow interior (31).

The housing (11) may have a shape and a water feed in any desired, suitable configuration. It may have, e.g., a tubular configuration and have one or two housing openings on the front side for water feed. As an alternative or in addition, one or more jacket openings are possible for water feed. Guiding means for the water flow and the distribution thereof may be present in the hollow interior (31) of the housing (11). It is achieved by means of suitable actions for generating and guiding a uniform, especially laminar flow, that the same water pressure prevails at the nozzle strip (16) over the entire length and identical discharge conditions prevail at the nozzle orifices (24).

The nozzle bar (10) may have any desired cross-sectional geometry. In the embodiment shown, the cross section is rectangular, especially square. As an alternative, it may have a rounded, especially circular or oval configuration. Further, any desired, other prismatic cross-sectional shapes or the like are possible.

In the housing jacket (12), a jacket opening (13) is arranged on the side pointing toward the material web (2). The jacket opening (13) may extend in the longitudinal direction of the nozzle bar (10). A plurality of jacket openings (13) may also be present, e.g., in a parallel arrangement. The jacket opening (13) may continue in one piece over the bar length or may be interrupted. It preferably has a straight extension aligned along the bar axis.

A nozzle strip (16) is arranged within the housing (11) as well as at and preferably in the jacket opening (13). This nozzle strip (16) has a trough-shaped cross section. The nozzle strip (16) is also designated as a nozzle configuration. It preferably consists of a thin-walled material.

FIGS. 2 through 5 illustrate the arched, omega-shaped cross-sectional geometry of the nozzle strip (16). This nozzle strip (16) has a centrally arched nozzle body (19) and possibly retaining elements (18), which are arranged on the edge thereof on one side or on both sides and protrude laterally. The retaining elements (18) may be configured, e.g., as bent retaining flanges.

The jacket opening (13) has a slot-like configuration in the exemplary embodiments shown and represents an opening in the housing jacket (12). The nozzle strip (16) preferably has a consistent cross-sectional shape over its length and is configured as a thin-walled profile (17). It preferably consists of metal, especially of steel or a non-ferrous metal.

In the exemplary embodiments shown, the metal profile (17) is bent in one piece from a thin-walled sheet metal strip. As an alternative, it may be a drawn or pressed metal profile. The nozzle strip (16) or the profile may also be manufactured from a solid material by means of machining or in a different way. As an alternative, other materials, e.g., a high-strength plastic or the like are also possible. The nozzle strip (16) or the profile (17) may also have a multipart configuration.

Figure 3:
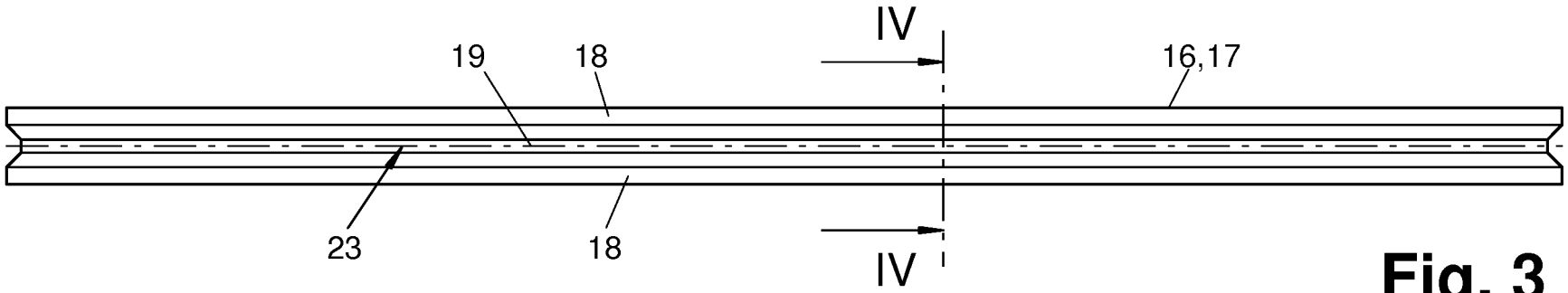
FIG. 3 is a top view of a nozzle strip.
Figure 4:
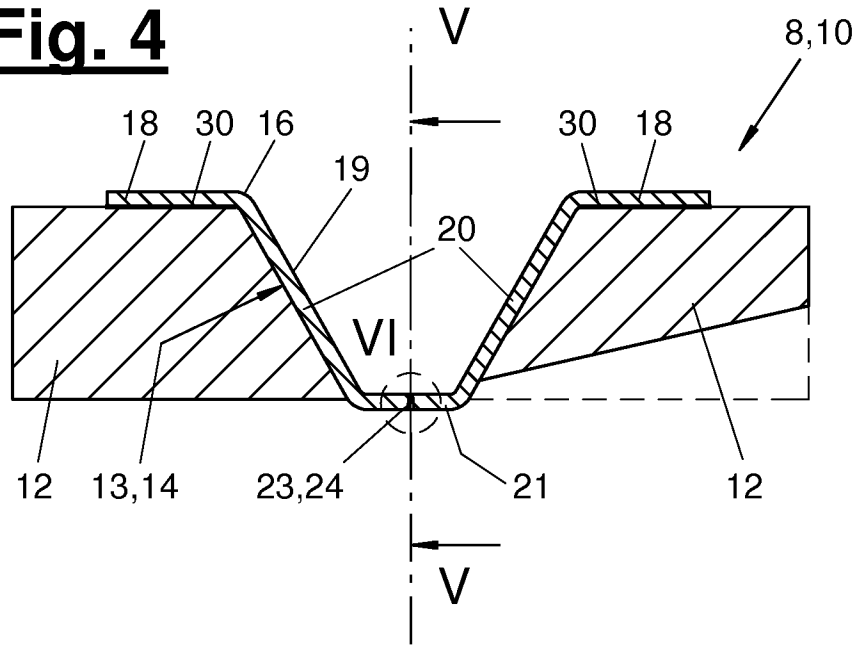
FIG. 4 is a section through the nozzle strip according to section line IV-IV of FIG. 3 together with a part of the nozzle bar.
Figure 5:
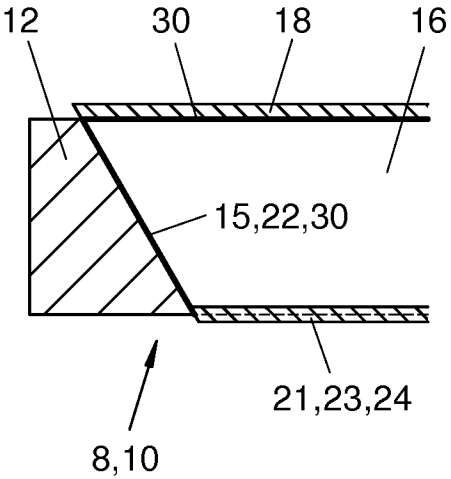
FIG. 5 is a broken-off longitudinal section through the nozzle strip and the nozzle bar at the end area on the front side according to section line V-V of FIG. 4.

As FIGS. 3 through 5 illustrate, the nozzle body (19) has an essentially U-shaped or V-shaped cross section. The V-shaped or conical cross section tapers in the jet emission direction (5). The nozzle body (19) is hollow and open towards the interior of the nozzle bar (10). It has a side body wall (20) and a body bottom (21) with a plurality of nozzle orifices (24) for the discharge of a water jet (5) there. The body bottom (21) preferably has a planar configuration. The body bottom (21) may be aligned parallel to the material web (2) or to the carrier (3).

As FIGS. 2, 4 and 5 illustrate, the nozzle body (19) is arranged retracted in the jacket opening (13). The retaining elements (18) lie on both sides of the jacket opening (13) on the adjoining housing jacket (12) and are supported here. A seal (30) may be arranged under the retaining elements (18) and/or under the body wall (20).

FIG. 2 also shows, in dotted line, the state of the art, in which a planar nozzle strip provided with a row of holes lies on the inside on the housing jacket (12) and over the jacket opening (13). The water jet (5) being discharged at prior-art nozzle strips must first pass through the jacket opening extended towards the row of holes before it is discharged from the nozzle bar (10). Because of the high water pressure and the necessary strength, the housing jacket (12) or the side housing wall has a certain wall thickness, which is noticeably included in the opening depth and the free jet length.

In the exemplary embodiments shown, the nozzle strip (16) with its body bottom (21) protrudes beyond the external edge of the jacket opening (13) and projects a little above the outside of the bar. As an alternative, the nozzle strip (16) may line up precisely with the external edge of the jacket opening (13) or possibly also end before this edge.

FIG. 4 illustrates, in addition, two variants in the configuration of the housing jacket area (12) adjacent to the jacket opening (13). The housing jacket (12) has a consistent thickness in the left half of the figure, the jacket outside being aligned parallel to the body bottom (21). The right half of the figure shows a variant with a tapered jacket outside. In this variant, the same jacket slope is arranged mirror-inverted to the water jet axis (5), so that the housing jacket (12) is configured as conical on the outside and thickening toward the jacket opening (13).

As FIGS. 4 and 5 illustrate, the jacket opening (13) ends on each front side at a distance in front of the nozzle bar end or the cover there. The jacket opening (13) may in this case have a shape that is both conical in cross section and in longitudinal section and tapering toward the outside of the bar. The jacket opening (13) has oblique side walls (14) and oblique front walls (15).

The nozzle body (19) may have a corresponding cone shape tapering toward the outside of the bar or in the jet emission direction and have a oblique side body wall (20) as well as oblique front sides (22). The front sides (22) are flatly in contact with the respective corresponding and preferably planar front wall (15) or possibly with a seal (30) inserted there.

The side body wall (20) and the side walls (14) of the jacket opening (13) likewise preferably have a planar configuration and are flatly in contact with one another. Consequently, the side walls (14) support the body wall (20) against the pressure applied. The cone shape is advantageous for the water jet pressure, on the other hand. In addition, the width of the body bottom (21) is reduced, which is advantageous for the strength and inherent stability thereof.

Figure 7:
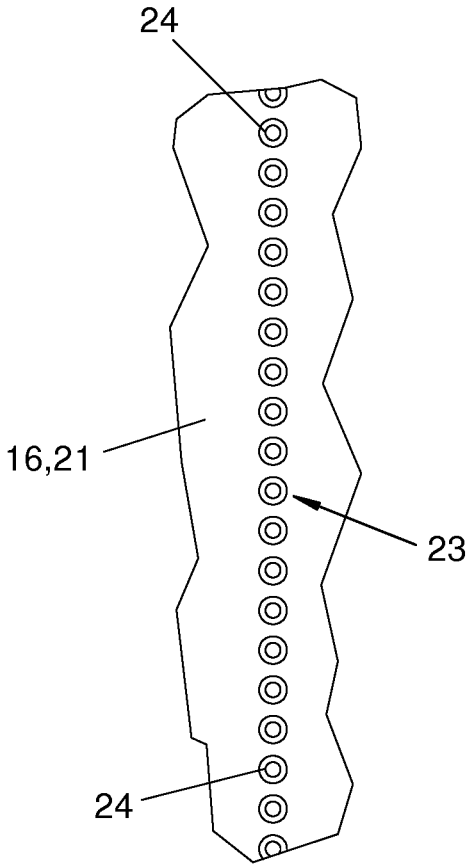
FIG. 7 is a top view, in sections, of an arrangement of rows of nozzle orifices at a nozzle strip.

In the body bottom (21), a plurality of nozzle orifices (24) are lined up one behind the other in the longitudinal direction of the nozzle bar (10). One or more rows of holes (23) can be formed hereby. Their length reaches at least over the width of the material web (2). FIG. 7 shows the variant with a single row of holes (23). In an arrangement with a plurality of rows of holes, two or more rows of holes (23) can be arranged in parallel, wherein they can be aligned synchronized in the longitudinal direction or offset to one another about the hole spacing.

Figure 6:
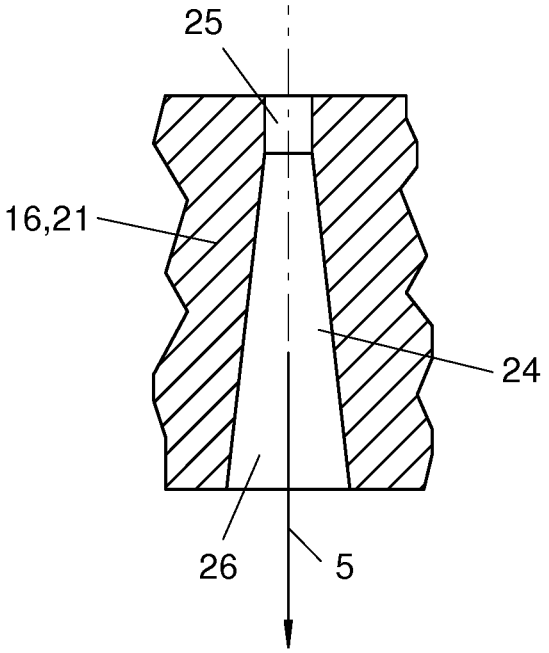
FIG. 6 is a longitudinal section through a nozzle orifice in the nozzle strip.

FIG. 6 shows a longitudinal section through a nozzle orifice (24) in the body bottom (21) as an example. The nozzle orifice (24) has, e.g., an upper orifice area (25), which may have a cylindrical shape, pointing toward the hollow interior of the nozzle bar (10). A lower and preferably longer orifice area (26), which extends conically in the jet direction in this exemplary embodiment, is connected hereto in the discharge direction of the water jet (5). The upper orifice area (25) may have a very small diameter. This may be, e.g., on the order of 0.01 mm to 0.30 mm, and preferably 0.07 mm to 0.17 mm.

As FIGS. 1 and 2 illustrate, the water jets (5) being discharged from the nozzle orifices (24) are directed at a suitable angle, preferably vertically against the material web (2), this material web (2) being supported on the perforated carrier (3). Corresponding to the row of holes configuration, one or more rows of water jets are generated obliquely over the material web (2). The nozzle orifices (24) are arranged at a distance above the material web (2), wherein a free jet length is obtained between the discharge at the respective nozzle orifice (24) and the striking of the material web (2).

An adjusting device (34), which is schematically indicated with arrows in FIG. 1, for changing the distance, may be arranged between the nozzle bar (10) and the material web (2), and especially the carrier (3). For example, the nozzle bar (10) is mounted in a vertically adjustable manner. The desired free jet length of the emitted fluid jet (5) or water jet can be adjusted by the adjusting device (34).

The striking water jets (5) move and deform the fibers in the material web (2), and they compact and entangle the fiber composite. Some of the water jets (5) are reflected by the material web (2) and the carrier (3) as splash water or spray water (7). The spray water (7) may be taken up by the outside of the housing jacket (12) possibly as condensation water, and it remains outside of the area of the emitted water jet. The preferred embodiment with a nozzle strip (16) protruding from the jacket opening (13) or lining up precisely with the jacket outside is hereby advantageous.

By means of the suction device (4) arranged below the carrier (3), the other water can be suctioned off on the rear side of the perforated carrier (3) and be removed from the material web (2). In this case, ambient air may be suctioned through the gap between the nozzle bar (10) and the material web (2) as well. FIG. 2 schematically shows the air flows (6). In case of the screen rollers (29) of FIG. 1, the suction devices (4) are located stationarily within the rotating screen rollers (29).

In the embodiment of a hydroentanglement device (1) shown in FIG. 1, the material web (2) is guided via two adjacent and countercurrently rotating screen rollers (29) and is thereby entangled in a plurality of steps by means of a plurality of nozzle bars (10). The nozzle bars (10) are aligned radially to the respective screen roller and are arranged distributed on the circumference thereof. In this connection, one or more nozzle bars (10) may emit the water jets against gravity vertically or obliquely upwards. They are arranged, e.g., on the bottom of the lower screen roller (29).

Figure 8:
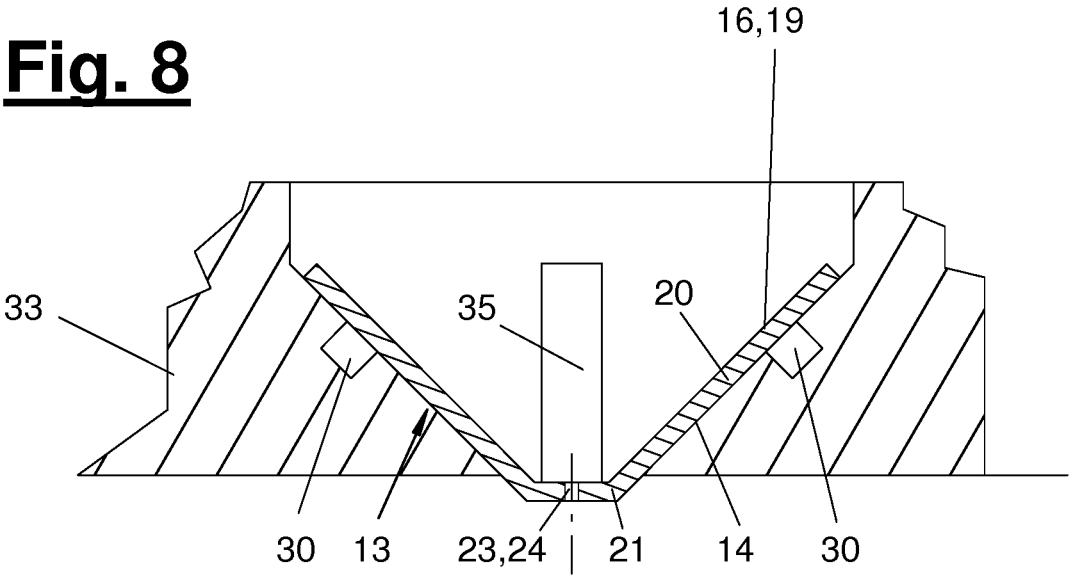
FIG. 8 is a variant of the nozzle strip.

FIG. 8 shows a variant of the housing (11) and of the nozzle strip (16) or of the nozzle body (19). The housing (11) has a housing jacket (12) with a bottom part (33) detachably fastened, especially bolted to the bottom, which accommodates the jacket opening (13) and the nozzle strip (16).

In the variant of FIG. 8, the nozzle strip (16) only has the nozzle body (19), wherein the retaining elements (18) are dispensed with. The seals (30) for the nozzle body (19) running conically in the jet direction are arranged on the corresponding side walls (14) of the jacket opening (13). In this embodiment as well, the planar body bottom (21) with the nozzle orifices (24), especially with the one or more rows of holes, projects a little above the lower edge or the mouth of the jacket opening (13).

FIG. 8 illustrates, in addition, the arrangement of a guide (35) for the nozzle strip (16) on one or both front sides. The guide (35) is formed, e.g., by an axial, strip-like projection on one or both front walls (15) of the jacket opening (13) and by a part of the nozzle strip (16) interacting with it. The nozzle strip (16) may have a front wall with a recess corresponding to the projection for a positive-locking connection. On the other hand, the projection may be spaced a little upwards, so that the body bottom (21) according to FIG. 8 can be axially pushed in under the projection.

Figure 9:
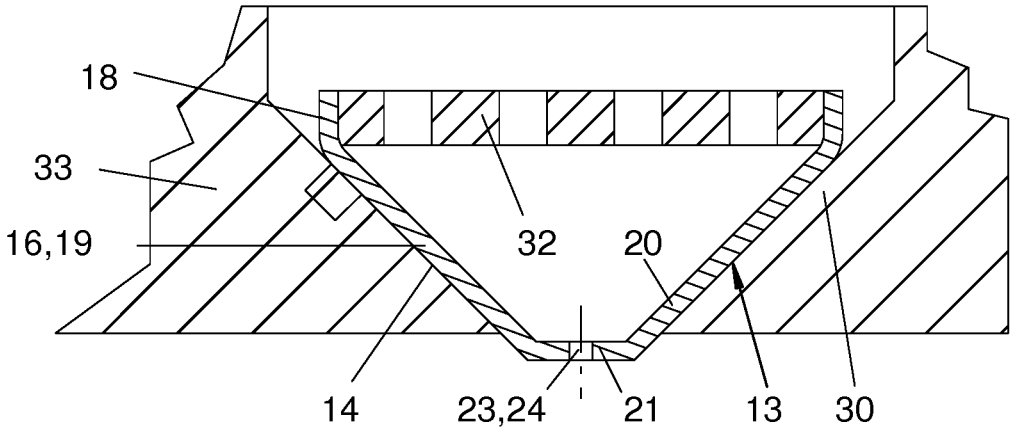
FIG. 9 is another variant of the nozzle strip.

FIG. 9 shows a second nozzle variant, which differs from the above-mentioned first variant by a perforated cover (32) at the inlet opening of the nozzle body (19). The cover (32) is configured, e.g., as a perforated plate, which can be retained and fastened to upwards-angled, lateral retaining elements (18) of the nozzle strip (16). The perforated cover (32) is located between the interior (31) of the housing (11) and the interior of the hollow nozzle body (19).

Further, in this and in the other embodiments, cross bracings, e.g., in the form of installed or welded cross ribs, can be arranged in the interior of the nozzle body (19).

A variety of variants of the embodiments shown and described are possible. The individual features of the above-described exemplary embodiments and of the variants mentioned may, in particular, be combined with one another as desired, and may especially also be transposed.

Another variant concerns the cross-sectional geometry of the jacket opening (13) and of the nozzle strip (16), and especially of its nozzle body (19). A U shape may be provided instead of the conical shape. A V shape is also possible.

In the nozzle orifice (25) in the variant of FIG. 7, the lower orifice area (26) pointing toward the material web (2) may have a cylindrical configuration or conically tapering configuration. Further, a reversal of the geometries is possible, wherein the narrow, especially cylindrical orifice area is arranged on the outside of the nozzle orifice (24) pointing toward the material web (2). It may have a short length. The upper and possibly longer orifice area is then configured in a suitable manner, e.g., conically, wherein it extends toward the hollow interior of the nozzle bar (10).

In a variant of the embodiment of FIG. 1, the hydroentanglement device (1) may have a planar conveying path for the material web (2) and one or more nozzle bars (10) arranged next to one another along the conveying path. These nozzle bars (10) may be directed from one side, especially from the top side, or from both sides against the material web (2) and work with the water jets (5) emitted.

While specific embodiments of the invention have been shown and described in detail to illustrate the application of the principles of the invention, it will be understood that the invention may be embodied otherwise without departing from such principles.

The invention claimed is:

1. A nozzle bar for a hydroentanglement device, the nozzle bar being configured to emit water jets, the nozzle bar comprising:

a hollow housing with a housing jacket and with a jacket opening; and a nozzle strip arranged in the hollow housing, wherein the nozzle strip has a trough-shaped cross section with a nozzle body arranged retracted in the jacket opening, the nozzle body having an essentially V-shaped cross section with a side body wall and with a body bottom, in which nozzle orifices are arranged for a discharge of a water jet, the body bottom being arranged in an area of an external edge of the jacket opening, the jacket opening having a slot jacket opening and the jacket opening extending along a longitudinal axis of the housing, the jacket opening and the nozzle body having cross-sectional contours which correspond to one another, the cross-sectional contours being conical, wherein the side body wall and side walls of the jacket opening are in flat contact with one another.

2. A nozzle bar in accordance with claim 1, wherein the housing jacket has a conical configuration on an outside of the hollow housing.

3. A nozzle bar in accordance with claim 1, wherein:

the nozzle strip has a retaining flange, arranged laterally on the nozzle body; and the retaining flange is supported on the housing jacket next to the jacket opening.

4. A nozzle bar in accordance with claim 1, wherein:

a perforated cover is arranged at an access opening of the nozzle body; and a cross bracing is arranged in the nozzle body.

5. A nozzle bar in accordance with claim 1, wherein the side body wall of the nozzle is in contact with a lateral edge of the jacket opening and the nozzle body is supported via the lateral edge.

6. A nozzle bar in accordance with claim 1, wherein the nozzle body comprises an oblique front side body wall, the oblique front side body wall being in contact with a front-side edge of the jacket opening and the nozzle body being supported via the front-side edge.

7. A nozzle bar in accordance with claim 1, wherein at least one of the nozzle orifices has a conical shape in at least some areas in a longitudinal section.

8. A nozzle bar in accordance with claim 1, wherein at least a portion of the nozzle body extends from a position located in an interior space of the hollow housing to a position located external to the interior space of the hollow housing.

9. A hydroentanglement device, the device comprising:

a nozzle bar with a hollow housing with a housing jacket and with a jacket opening, the nozzle bar being configured to emit water jets; and a nozzle strip associated with the hollow housing, wherein the nozzle strip has a trough-shaped cross section with a nozzle body arranged in the jacket opening, the nozzle body having an essentially V-shaped cross section with a side body wall and with a body bottom, in which nozzle orifices are arranged for a discharge of the water jets, the body bottom being arranged in an area of an external edge of the jacket opening, the jacket opening having a slot jacket opening and the jacket opening extending along a longitudinal axis of the housing, the jacket opening and the nozzle body having cross-sectional contours which correspond to one another, the cross-sectional contours being conical, wherein the side body wall and side walls of the jacket opening are in flat contact with one another.

10. A hydroentanglement device in accordance with claim 9, further comprising a pressurized water supply.

11. A hydroentanglement device in accordance with claim 9, further comprising a carrier and a conveying device for a fibrous nonwoven web to be entangled.

12. A hydroentanglement device in accordance with claim 9, wherein:

a carrier is configured permeable to fluids as a screen roller;

a suction device is arranged on a side of the carrier in an area of a nozzle bar.

13. A hydroentanglement device in accordance with claim 9, further comprising another nozzle bar to provide at least a plurality of nozzle bars, the plurality of nozzle bars being arranged distributed about a circumference of a cylindrical carrier.

14. A hydroentanglement device in accordance with claim 13, wherein one or more of the plurality of nozzle bars are arranged adjacent to a bottom of the carrier.

15. A hydroentanglement device in accordance with claim 9, wherein an adjusting device is arranged between the nozzle bar and a carrier for changing a distance and a free jet length of a fluid jet emitted.

16. A method for hydroentanglement, the method comprising:

directing fluid jets toward a material web with a nozzle bar comprising a hollow housing with a housing jacket and with a jacket opening as well as with a nozzle strip arranged in the hollow housing, wherein the water jets are emitted by the nozzle strip, which has a trough-shaped cross section with a nozzle body that is arranged retracted in the jacket opening, the nozzle body having a V-shaped cross section with a side body wall and with a body bottom, in which nozzle orifices are arranged for a discharge of the water jets the body bottom being arranged in an area of an external edge of the jacket opening, the jacket opening having a slot jacket opening and the jacket opening extending along a longitudinal axis of the housing, the jacket opening and the nozzle body having cross-sectional contours which correspond to one another, the cross-sectional contours being conical, wherein the side body wall and side walls of the jacket opening are in flat contact with one another.

17. A method in accordance with claim 16, wherein the material web is supported on a perforated and rear-suctioned carrier.

18. A method in accordance with claim 16, wherein the nozzle bar is configured to emit the water jets against gravity vertically or obliquely upwards against the material web.

19. A nozzle bar for a hydroentanglement device, the nozzle bar comprising:

a hollow housing with a housing jacket and with a jacket opening; and a nozzle strip arranged in the hollow housing, wherein the nozzle strip has a trough-shaped cross section with a nozzle body arranged retracted in the jacket opening, wherein a portion of the nozzle body protrudes beyond an external hollow housing edge of the hollow housing, the external hollow housing edge defining at least a portion of the jacket opening, the external hollow housing edge being located at an outermost periphery of the hollow housing.

20. A nozzle bar in accordance with claim 19, the nozzle bar being configured to emit water jets, the hollow housing comprising a housing side wall defining at least a portion of a slot jacket opening extending along a longitudinal axis of the hollow housing, the nozzle body comprising a nozzle body side wall, the nozzle body side wall and the housing side wall comprising a cross-sectional conical contour, the nozzle body side wall being in planar contact with the housing side wall, the portion of the nozzle body comprising a nozzle body outlet for a flow of fluid, the nozzle body outlet being located at a position outside of the outermost periphery of the hollow housing.

* * * * *